United States Patent [19]

Kibler et al.

[11] 4,019,273

[45] Apr. 26, 1977

[54] THREE-BARREL PISTOL, ELECTRODE FIRED

[75] Inventors: Ralph J. Kibler, Phoenix; Otho C. Wolfe, Darlington, both of Md.

[73] Assignee: The United States of America as represented by the Secretary of the Army, Washington, D.C.

[22] Filed: June 7, 1976

[21] Appl. No.: 693,401

[52] U.S. Cl. ..... 42/1 R; 42/84; 73/167; 89/1 R

[51] Int. Cl.[2] ..... F41C 27/00; F41C 19/12

[58] Field of Search ..... 42/1 R, 71 P, 40, 73, 42/84; 89/1 R, 1 L, 1 N, 37 BA; 73/167

[56] References Cited

UNITED STATES PATENTS 2,731,829 1/1956 Wigington et al. ..... 42/1 R

*Primary Examiner*—Charles T. Jordan

*Attorney, Agent, or Firm*—Nathan Edelberg; Robert P. Gibson; Saul Elbaum

[57] ABSTRACT

An automatic pistol is disclosed having both an electronic firing means for providing variable rates of fire and a grip adjustable to positions ranging from directly behind the barrel to positions above and below the barrel.

9 Claims, 6 Drawing Figures

THREE-BARREL PISTOL, ELECTRODE FIRED

RIGHTS OF THE GOVERNMENT

The invention described herein may be manufactured, used, and licensed by or for the United States Government for governmental purposes without the payment to us of any royalty thereon.

BACKGROUND OF THE INVENTION

The present invention relates to a pistol and more particularly to a pistol having a variable rate of fire and an adjustable grip.

In the design of pistols it would be useful to know the rate of fire and pistol grip position which would have the least undesirable effects upon the aim and accuracy of the shooter due to recoil. Such information is not available through testing of available pistols because their rates of fire are limited by the time required for the gas operated ejector slide mechanism to complete its eject and reload cycle. Further, no practical means has previously been available for relocating the handgrip relative to the barrel centerline. Because of the slide mechanism the grip could not be located directly behind the barrel centerline without either making the piston "nose - heavy" or interfering with the slide mechanism.

Accordingly it is an objective of the invention to provide a pistol having an adjustable rate of fire and an adjustable grip position which may be used to study the effects of rate of fire and grip position on the aim and accuracy of a shooter.

A further objective is to provide such a pistol in a design which will conform with normal pistol weight and weight distribution.

More particularly, it is an objective of this invention to provide a pistol capable of firing multiple rounds automatically without the need for a slide ejector, so that the grip may be located directly behind the barrel centerline.

Yet another objective of the invention is to provide electronic firing means for automatically and sequentially firing cartridges in a plurality of barrels.

Still another object of the present invention is to provide an electronic firing means of the nature described above having an adjustable rate of fire and having the capability of either firing a prescribed number of rounds when triggered or firing until the trigger is released.

Various other objects and advantages will appear from the following description of one embodiment of the invention, and the most novel features will be particularly pointed out hereinafter in connection with the appended claims.

SUMMARY OF THE INVENTION

The foregoing objects are accomplished in a pistol having a plurality of barrels sequentially fired by electronic means, with the grip adjustable to various positions behind the barrel.

DESCRIPTION OF THE DRAWINGS

FIG. 1-A is an end view of the barrels of FIG. 1.

As shown in FIG. 1, the preferred embodiment of the present invention includes barrel assembly 10, grip assembly 12, and fire controller 14. To provide rapid rates of fire while preserving a favorable weight distribution and securing the freedom to locate the grip directly behind the barrel centerline, three barrels 16 were used, electrically fired in sequence by fire controller 14. The use of a plurality of barrels was necessary to avoid the typical gas operated ejector slide mechanism which would have precluded locating the grip directly behind the barrel.

Figure 1:
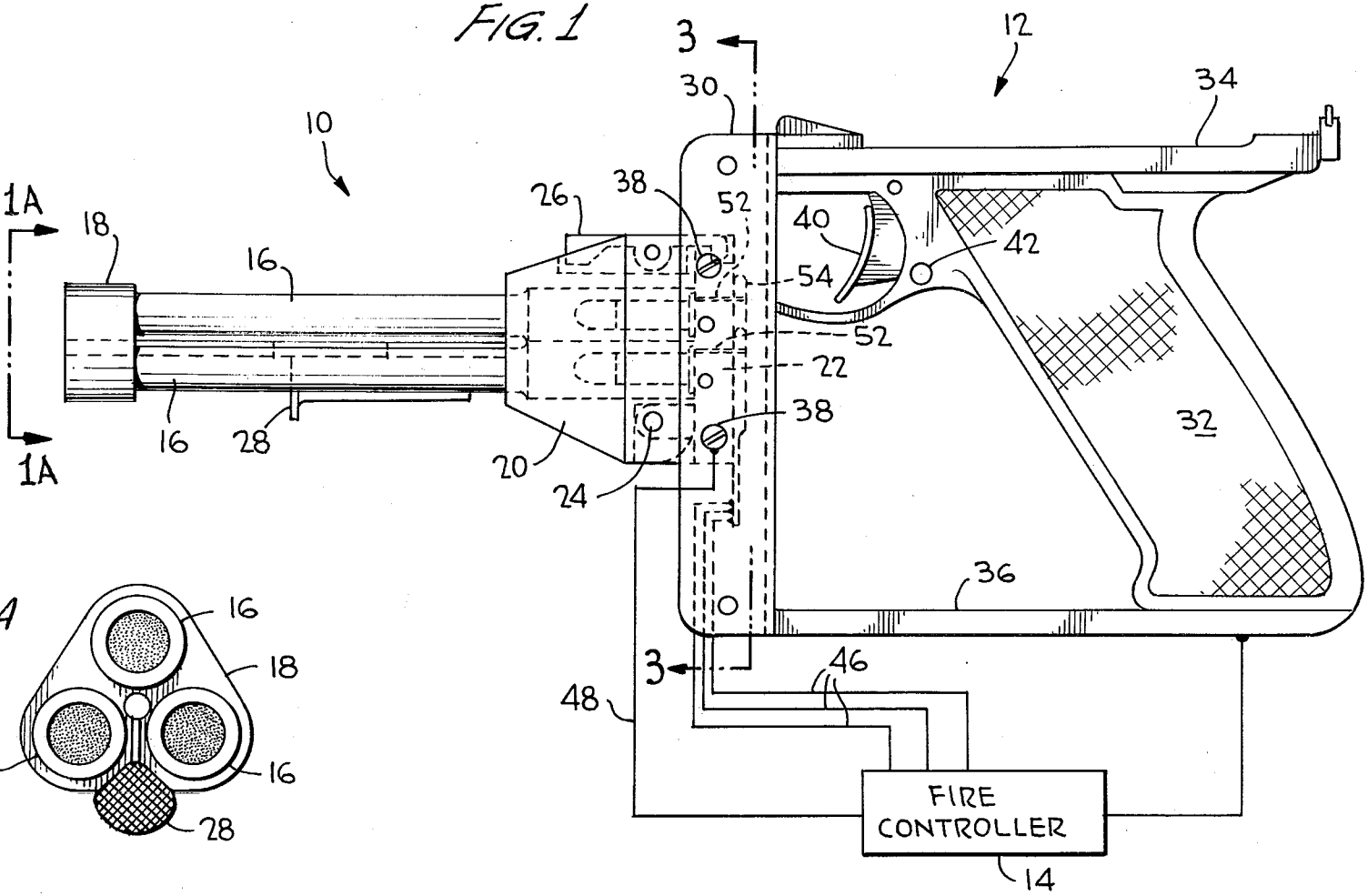
FIG. 1 is an illustration of the pistol of the invention.
Figure 1A:
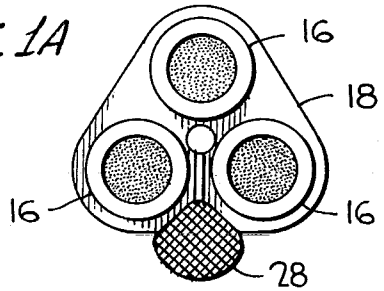
Figure 2:
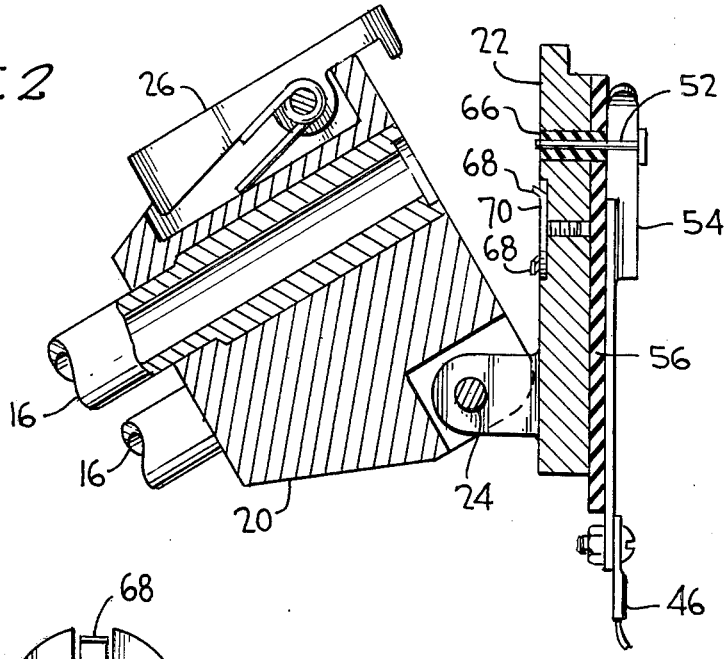
FIG. 2 is a sectional view of the barrel mating block and breech plate assembly of the embodiment of FIG. 1.

Barrel assembly 10 includes the barrels 16 held in a fixed parallel relationship by front barrel support 18 and barrel mating block 20 at the rear. The rear of the barrel assembly is closed by breech plate 22 attached to barrel mating block 20 at pivot 24. Loading and unloading is accomplished by opening the barrel latching mechanism 26 and breaking open the pistol about pivot 24 as shown in FIG. 2. Cartridges may then be inserted by hand or removed by moving the ejector slide 28 rearward to eject the three cartridges simultaneously, in a manner similar to a double barrel shotgun.

The barrel assembly 10 is mounted on grip assembly 12 by means of barrel mating channel 30. Barrel mating channel 30 is attached ahead of handle 32 by a top plate 34 fastened to the top of mating channel 30 and handle 32 and by bottom plate 36. Vertical positioning of the barrel assembly 10 relative to the grip assembly 12 is accomplished by removing screws 38, sliding the barrel assembly up or down between the walls of the barrel mating channel 30 and replacing the screws in the additional holes provided in the mating channel.

Figure 4:
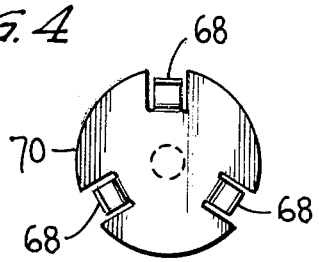
FIG. 4 illustrates the grounding plate which mounts on the breech plate.
Figure 3:
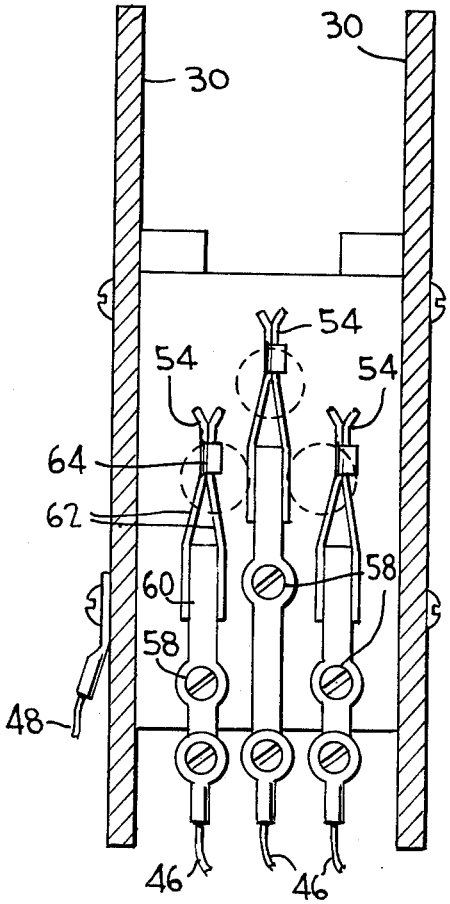
FIG. 3 is a view of the breech plate showing the electrical connections thereto.

A trigger 40, having a conventional button type trigger safety 42, is used to operate a switch 44 (shown in FIG. 5), to start the function of fire controller 14. The fire controller is connected to the pistol by three firing leads 46 and grounding lead 48. In this firing system three replaceable steel electrodes 52 are gripped and spring loaded by three electrode springs 54 mounted on an insulator board 56, both of which are mounted on the rear of the breech plate 22 by means of nylon screws 58 (note FIGS. 2 and 3). Each electrode spring 54 is formed from sheet material, to have a base 60 from which two clamping arms 62 extend for clamping one end of an electrode 52 therebetween. On one of the clamping arms is a cap 64 for spring biasing the electrode against the cartridges. The three electrodes 52 are fed through insulating bushings 66 in the breech plate 22 in positions to bear against the primer area of the rimfire cartridge used. The bases of the cartridges are grounded to the breech plate 22 by spring fingers 68 on grounding plate 70 (FIGS. 2 and 4) and through ground lead 48 to the fire controller 14.

When the trigger is pulled the fire controller 14 operates to sequentially discharge three precharged capacitors 72 in the controller through the firing leads to fire the rimfire cartridges loaded in the pistol. The electrical charge causes a build up of heat due to the inability of the fine point on the steel electrode to carry the high surge current imposed on it when the capacitor discharges. In the process, the heat generated destroys the tip of the steel electrode and burns the cartridge case in the area of the primer, causing the round to fire. The elapsed time from capacitor discharge to completed ignition of the primer is approximately three milliseconds.

Figure 5:
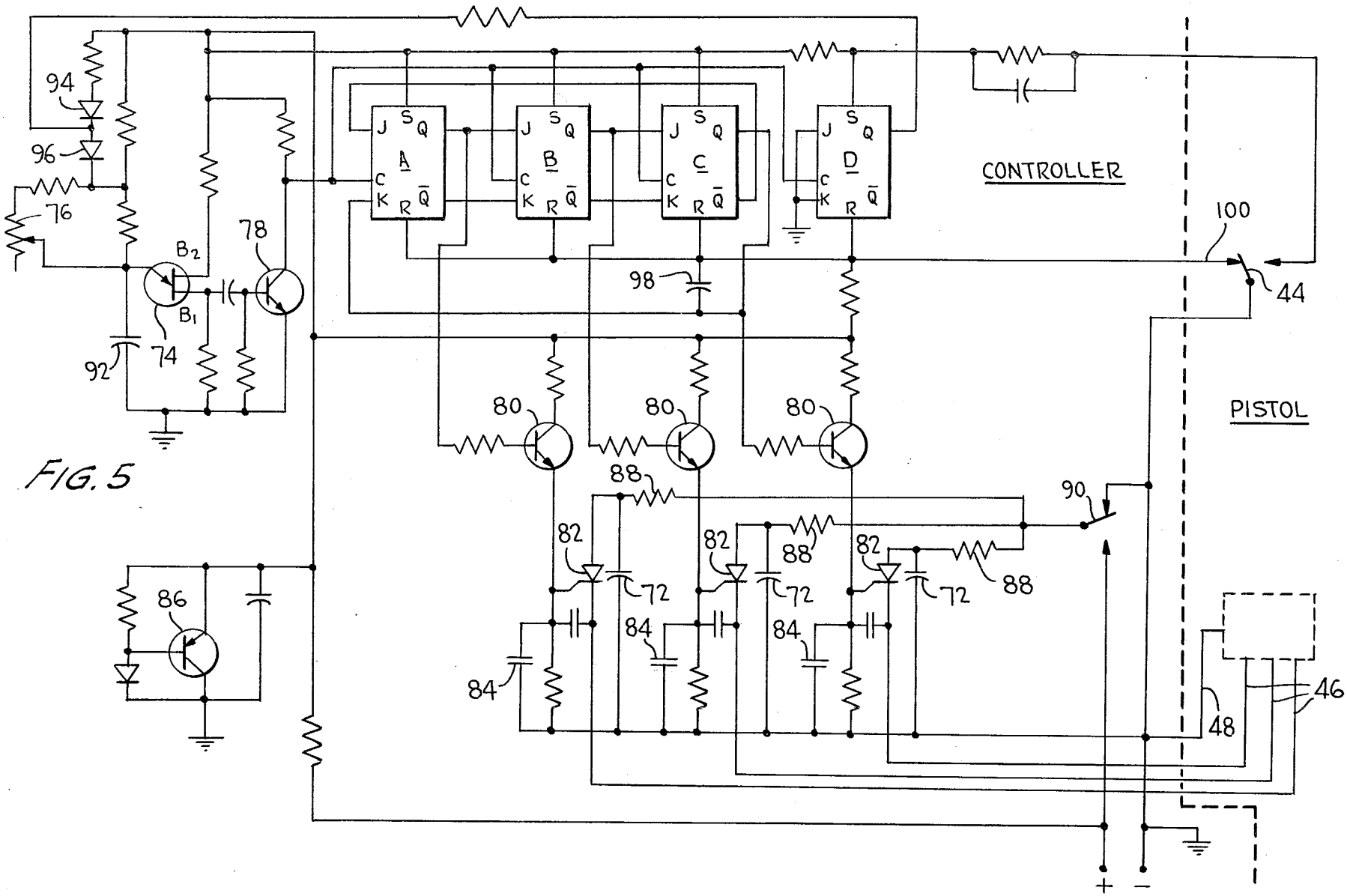
FIG. 5 is a schematic diagram of the electronic fire controller unit, used to control the pistol of FIG. 1.

The fire controller 14, schematically shown in FIG. 5, is a solid state, electronic device. The pistol firing rate is established by a unijunction transistor relaxation oscillator, the frequency of which is varied by a ten turn potentiometer 76. The circuit has been modified to permit the oscillator to be gated from the "off" state, to an "on" or free running state. Positive pulses from base one (B1) of the oscillator transistor are amplified and inverted by a transistor amplifier stage 78. These negative pulses drive the clock inputs (C) of integrated circit J-K binaries A, B, C and D. Binaries A, B, and C are connected as a ring counter to control the firing sequence of the barrels. Binary D is used to gate the oscillator. Outputs from the ring counter are fed to transistors 80 which supply driving currents to the gate elements of silicon controlled rectifiers 82. The SCR's 82, when turned on provide the discharge path for the firing capacitors 72 through the electrodes and cartridge cases. Capacitors 84 are used to suppress noise pulses generated by the arc formed at the electrode tip. If not suppressed, these pulses can cause sporadic triggering of the other SCR's.

The unit is powered from a 30 volt D.C. source. The 5 volts required in the control circuits is derived by means of a transistor shunt regulator 86. The 12,000 micro-farad firing capacitors 72 are charged to 30 volts through current limiting resistors 88 when push button switch 90 is depressed.

In the quiescent condition, the Q outputs of all four binaries are in the low state and the capacitor 92 at the emitter of the unijunction transistor 74 is charged to near the firing potential but is inhibited by the low voltage applied at the junction of diodes 94 and 96.

When the trigger is pulled, it actuates the switch 44, momentarily grounding the S (set) input of binary D, causing the Q output of binary D to switch to the high state. The high output of binary D is connected to the junction of diodes 94 and 96, serving as the oscillator gate. The oscillator starts pulsing at a rate determined by the RC time constant of the unijunction emitter circuit. Amplifier 78 supplies negative pulses to drive the clock inputs (C) of the binaries. Since the J and K inputs of binary D are grounded the clock pulse has no effect on the output which is fed back to complete the oscillator circuit. Because the $\overline{Q}$ output of binary C has been in the low state and therefore fed to the J input of binary A, the first clock pulse fed to the C input of binary A switches binary A so that its output is high and delivered to the J input of binary B. Thus the second clock pulse will switch binary B so that its output is high, and, similarly, the third clock pulse will switch binary C so that its output will be high. The high output of binary C being connected to the K input of binary A, the fourth clock pulse will switch binary A's output to the low state. Then the fifth and sixth clock pulses will switch the outputs of binary B and C to the low state. Now capacitor 98 couples the output of binary C to the R input (reset) of all the binaries. Thus when the output of binary C switches from high to low, a negative pulse is applied to all the R inputs, resetting all the binaries so that their output is low. When binary D switches to the low state, the gating diodes 94 and 96 turn off the oscillator 74. The normally closed contact 100 of trigger switch 44 is wired to the binaries' reset line R so that, if the trigger is released, it will interrupt the sequence by immediately resetting all the binaries. If it is desired to have the trigger start the sequence and not be able to interrupt it, the wire from normally closed contact 100 may be disconnected.

The high outputs of binaries A, B, and C each drive one of the identical capacitor discharge circuits to fire the three barrels in sequence. The high output of binary A drives the base of a transistor emitter follower 80 connected to the gate of a silicon controlled rectifier 82. When the SCR is gated on, a capacitor 72 is discharged through the series path of the SCR, electrode, cartridge case and interconnecting wires, firing the cartridge in one barrel. The other two barrels are fired when initiated by the high outputs of binary B and C respectively.

We wish it to be understood that we do not desire to be limited to the exact details of construction shown and described, for obvious modifications can be made by a person skilled in the art.

We claim:

1. A pistol for determining design parameters for a handheld weapon comprising:

1. barrel means;
2. means for loading cartridges in said barrel means;
3. cartridge firing means;
4. grip means supporting said barrel means; and
5. adjustment means for changing the position of said grip means to positions ranging from directly behind the center of said barrel means to above and below said barrel means.

2. The pistol of claim 1 wherein said cartridge firing means comprises adjustable electronic firing control means for firing said cartridges at preselected rates of fire.

3. The pistol of claim 2 wherein said barrel means comprises a plurality of parallel barrels.

4. The pistol of claim 3 wherein said adjustable electronic firing control means comprises a plurality of capacitor discharge circuits for supplying electrical pulses to fire said cartridges, an adjustable frequency gated oscillator to sequentially supply pulses to discharge said capacitor discharge circuits, a trigger operated switch for gating said adjustable frequency gated oscillator to initiate firing; and a power supply means to charge said capacitor discharge circuits and power said oscillator.

5. The pistol of claim 4 wherein said cartridge firing means further comprises electrodes for grounding by way of said cartridges, said capacitor discharge circuits discharging to ground through said electrodes, thereby firing said cartridges.

6. The pistol of claim 4 wherein said adjustable electronic firing control means further comprises a plurality of binaries connected as a ring counter with the clock inputs of said binaries receiving said pulses from said gated oscillator and the outputs from said binaries driving said capacitor discharge circuits.

7. The pistol of claim 6 wherein the number of said parallel barrels, the number of said binaries connected as said ring circuit and the number of said capacitor discharge circuits are all equal.

8. The pistol of claim 1 wherein said adjustment means comprises a mating channel fixedly attached to the front of said grip means and a breech plate slidably mounted in said mating channel, said barrel means being attached to said breech plate.

9. The pistol of claim 8 wherein said means for loading cartridges comprises a pivot between said barrel means and said breech plate whereby said barrel means and said breech plate may be pivotally opened and a latch means for holding said breech plate and barrel means closed.

* * * * *